United States Patent [19]

Stift et al.

[11] 4,396,421

[45] Aug. 2, 1983

[54] METHOD OF, AND ARRANGEMENT FOR, PRODUCING MOLTEN PIG IRON OR STEEL PRE-MATERIAL

[75] Inventors: Kurt Stift, Leoben; Walter Lugscheider, Linz, both of Austria

[73] Assignees: Voest-Alpine Aktiengesellschaft, Austria; Korf-Stahl Aktiengesellschaft, Fed. Rep. of Germany

[21] Appl. No.: 250,403

[22] Filed: Apr. 2, 1981

[30] Foreign Application Priority Data

Apr. 3, 1980 [AT] Austria ..... 1828/80

[51] Int. Cl.[3] ..... C21B 13/12; F27B 15/14

[52] U.S. Cl. ..... 75/11; 75/26; 373/24

[58] Field of Search ..... 75/11, 26, 12, 38; 13/2 P; 373/18, 19, 20, 21, 22, 23, 24, 25

[56] References Cited

U.S. PATENT DOCUMENTS

| | | | |
|---|---|---|---|
| 2,742,352 | 4/1956 | Gilliland | 75/26 |
| 2,978,315 | 4/1961 | Schenck | 75/26 |
| 3,783,167 | 1/1974 | Tylko | 75/10 R |

FOREIGN PATENT DOCUMENTS

| | | |
|---|---|---|
| 313491 | 3/1974 | Austria . |
| 28565 | 4/1964 | Fed. Rep. of Germany . |
| 28822 | 4/1964 | Fed. Rep. of Germany . |
| 1246780 | 2/1968 | Fed. Rep. of Germany . |
| 2116445 | 10/1972 | Fed. Rep. of Germany . |
| 2413588 | 10/1974 | Fed. Rep. of Germany . |
| 2507141 | 8/1975 | Fed. Rep. of Germany . |
| 1066866 | 4/1967 | United Kingdom . |
| 1496412 | 12/1977 | United Kingdom . |

OTHER PUBLICATIONS

Marnette et al., *Technische Mitteilungen*, 70 Jahrgang, Heft 2, Feb. 77, pp. 89–97

*Primary Examiner*—M. J. Andrews

*Attorney, Agent, or Firm*—Brumbaugh, Graves, Donohue & Raymond

[57] ABSTRACT

In a method of, and arrangement for, producing molten pig iron or steel pre-material iron-oxide-containing raw-material particles are top-charged into a fluidized bed formed of carbon particles and an oxygen-containing carrier gas. When passing the fluidized bed, the raw-material particles are heated, reduced and smolten. In order to achieve a better utilization of energy with such a method, i.e. to considerably lower the total energy input, additional energy is supplied to the fluidized bed by plasma heating.

32 Claims, 1 Drawing Figure

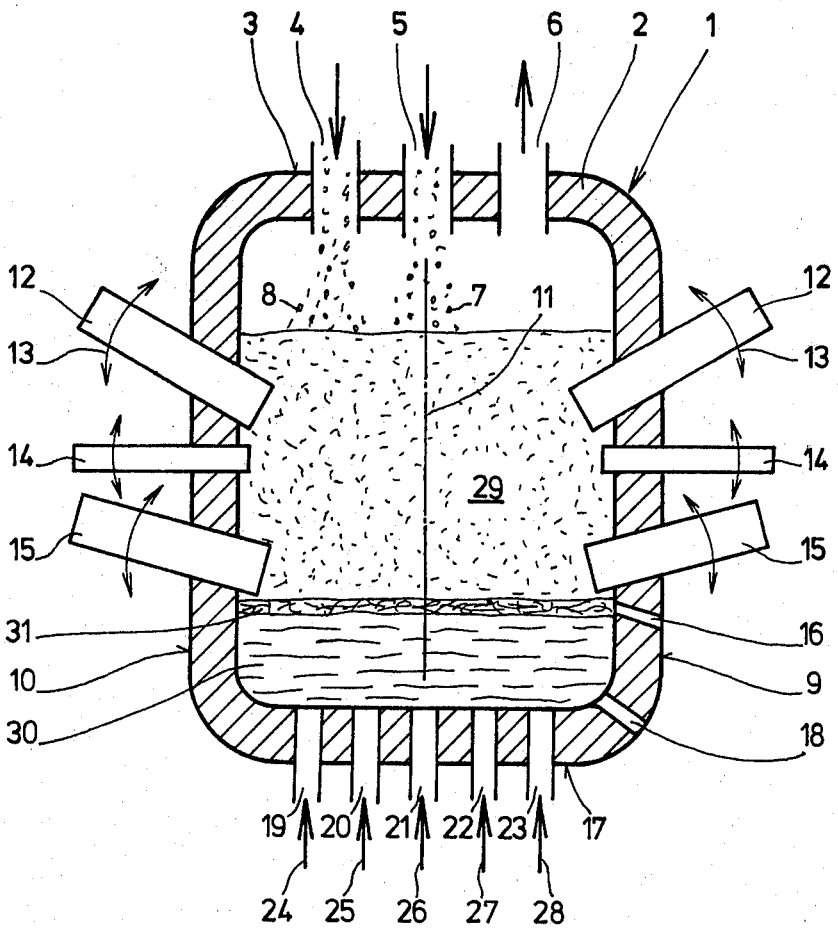
3
4
5
6
2
1
12
8
7
11
12
13
13
14
14
29
15
15
31
16
10
9
30
18
19
20
21
22
23
17
24
25
26
27
28

METHOD OF, AND ARRANGEMENT FOR, PRODUCING MOLTEN PIG IRON OR STEEL PRE-MATERIAL

BACKGROUND OF THE INVENTION

The invention relates to a method of producing molten pig iron or steel pre-material from iron-oxide-containing raw-material particles, in particular pre-reduced iron ore, in which the iron-oxide-containing raw-material particles are top-charged into a fluidized bed comprised of carbon particles and an oxygen-containing carrier gas and are heated, reduced and smelted when passing through the same, as well as to a plant for carrying out the method.

With the methods of this kind known so far, a high input of energy is necessary, with the utilization of the energy not being regarded as optimal, so that the heat balance and thus the economy of the known methods have not been satisfactory. Furthermore, it is not possible with the known methods to maintain the fluidized bed in a vessel of a great diameter. Therefore, one is all the more bound to relatively small vessels of little diameter, which is also not economical.

The charging of the oxygen-containing carrier gas has to be effected closely above the surface of the slag bath in order that the fluidized bed reaches up to this surface. With the known methods, this results in the formation of a zone of maximum temperature of the fluidized bed (high-temperature zone) in the lower region of the fluidized bed, i.e., closely above the slag bath surface. This has the disadvantage that in this zone a reoxidation of the iron-ore particles already reduced completely cannot be safely prevented.

SUMMARY OF THE INVENTION

The invention aims at avoiding these disadvantages and difficulties and has as its object to provide a method of the initially-defined kind as well as a plant for carrying out the method, in which the total energy input can be substantially reduced with a considerably more favorable utilization of energy, so that the reduction and smelting process may be carried out more economically than in accordance with the known methods.

This object is achieved according to the invention in that the fluidized bed is supplied with additional energy by plasma heating. The additional energy supply by plasma heating makes feasible a substantial reduction of the total energy input, due to the transmission of energy being effected primarily by radiation (on account of the high temperature of the plasma gas).

It is of a particular advantage if the plasma heating is effected in the upper region and/or central region following thereupon, of the fluidized bed, generating and maintaining there a zone of maximum temperature of the fluidized bed. Thereby the temperature closely above the slag bath surface can be kept relatively low and a reoxidation of the completely reduced (and already smelted) iron-ore particles immediately before penetrating the slag bath can be prevented.

The economy of the method is even further increased if part of the reduction gas formed in the fluidized bed is used as the plasma forming gas.

Advantageously, additional carbon carriers in solid and/or liquid form are charged into the flame region of the plasma heating.

A reduction of the total energy input of up to 50% is feasible if, as the iron-oxide-containing raw-material particles, between 50 and 70% pre-reduced iron-ore particles are charged into the fluidized bed and are completely reduced there.

Advantageously, carbon carriers in solid and/or liquid form are bottom-blown into the fluidized bed.

It is furthermore of an advantage to bottom-blow oxygen or oxygen-containing gases into the fluidized bed, wherein steel pre-material can be obtained as an end product.

For controlling the process, inert gas is suitably bottom-blown into the fluidized bed.

A plant for carrying out the method of the invention comprises a melting vessel with a refractory lining, which includes openings for supplying carbon-containing and iron-oxide-containing raw-material particles and openings for tapping slag and melt as well as openings for introducing the oxygen-containing carrier gas, and is characterized in that within the height of the fluidized bed plasma burners are installed in the wall of the vessel.

Suitably, the plasma burners are arranged in the upper and/or central height regions of the space of the melting vessel which is filled with the fluidized bed.

Advantageously, nozzles for carbon carriers in solid and/or liquid form, which are directed into the flame region of the plasma burners are provided in the vicinity of the plasma burners.

According to a preferred embodiment, the plasma burners are directed in the direction toward a central axis of the melting vessel and are annularly arranged about the axis of the vessel, the plasma burners being provided on several levels one above the other.

In order to be able to vary the zone of the maximally occurring temperature in the fluidized bed in terms of height and extension, the plasma burners suitably are arranged to be pivotable, in particular horizontally and vertically pivotable.

A preferred embodiment of the plant is characterized in that bottom nozzles are provided in the bottom of the melting vessel for supplying a carbon carrier and/or oxygen or oxygen-containing gases and/or an inert gas.

BRIEF DESCRIPTION OF THE DRAWING

The single FIGURE of the drawing shows a plant according to the invention in cross-section.

The invention will now be explained in more detail with reference to the accompanying drawing.

DETAILED DESCRIPTION OF AN EXEMPLARY EMBODIMENT

The drawing shows a melting vessel 1 in a schematic illustration in section, whose inner side is provided with a refractory lining 2. On the upper side 3 of the vessel, there are three openings 4, 5 and 6. One (5) of the openings serves for charging carbon or coke, preferably noncokable carbon 7, of different granulation, i.e. fine-grained to lumpy, into the melting vessel 1. The second opening 4 serves for feeding iron-oxide-containing raw-material particles, preferably 50 to 70% pre-reduced iron ore 8 being charged into the melting vessel. Through opening 6 also provided on the upper side of the melting vessel, a reduction gas which is used for pre-reducing the iron ore streams out of the melting vessel.

In the side walls 9, 10 of the melting vessel 1, indirect plasma burners 12, i.e., such equipped with a closed electric arc, are installed, which are directed in the direction toward the axis 11 of the melting vessel 1 and which may be designed as direct-current or alternating-current burners. The plasma burners 12 suitably are provided annularly in the side walls on one or more levels, wherein it is of a particular advantage if they are pivotable both vertically in the direction of arrows 13 and horizontally. Part of the reduction gas forming in the melting vessel 1 and streaming out through the opening 6 serves as the plasma-forming gas. However, also plasma-forming polyatomic gases and/or two or monoatomic inert gases may be used. Below the plasma burners 12 nozzles 14 are provided in the side walls 9, 10 of the melting vessel 1 for supplying the carbon carriers, by introducing the carbon carriers, preferably solid or liquid carbon carriers, into the flame region of the plasma burners 12. The oxygen-containing carrier gas, which serves for generating the fluidized bed, is introduced into the melting vessel through gas nozzles 15, which are also arranged in the side walls of the melting vessel below the plasma burners. Both the nozzles 14 and the gas nozzles 15 are pivotable to about the same extent as the plasma burners. Closely below the gas nozzles 15, a slag tap-hole 16 is provided. In the vicinity of the bottom 17 of the melting vessel a metal tap-hole 18 is arranged. The bottom itself comprises some further nozzles 19 to 23, through which carbon dust and/or coke dust 24, oxygen 25, inert gas 26, natural gas 27 or liquid carbon carriers 28 may be introduced into the melting vessel 1.

The melting vessel functions in the following manner: The pre-reduced iron ore 8 charged from above, preferably in the free fall, reaches the fluidized bed 29 extending from above the slag tap-hole 16 to above the plasma burners 12, travels downwardly through the same, is heated, reduced and smelten therein. The metal melt 30 collects below the slag layer 31. The generation of the reduction gas is effected, according to the embodiment illustrated, by the plasma heating of liquid and/or solid carbon carriers, which are introduced into the flame region of the plasma burners 12 through the nozzles 14. A further heat input for the necessary process heat is gained from the partial combustion of the carbon carriers used. This combined gasifying, reducing and smelting process may take place both at normal pressure and at an increased pressure.

The carbon carriers (carbon and/or coke dust, liquid hydrocarbons, natural gas, SNG-synthetic natural gas) introduced through the bottom nozzles 19 to 23, and the gases (oxygen and/or inert gas) introduced through the bottom nozzles serve for making corrections of the heat balance of the fluidized bed and for stabilizing the flow conditions. By using oxygen, a refining process may furthermore take place in the melting vessel 1, for the production of steel pre-material.

A considerable advantage of the introduction of energy into the combined gasifying, reducing and smelting process by means of plasma heating consists in the energy transmission occurring primarily by radiation, which is due to the high temperature (4,000° to 15,000° K.) of the plasma gas.

By the fact that the zone of maximum temperature is generated and maintained in the central region of the fluidized bed 29 or in the upper region thereabove, the temperature closely above the slag layer 31 can be kept relatively low, so that a reoxidation of the already completely reduced iron ore can be prevented. A reoxidation is considerably less likely to occur in the upper or central regions of the fluidized bed than in the lower region of the same, and moreover, in case a reoxidation does occur occasionally, it can be undone in the region of the fluidized bed 29 lying below the high-temperature zone, which region constitutes kind of an equilibrium zone.

A further advantage of the method according to the invention is to be seen in that the diameter of the melting vessel can be kept very large, which advantage is further increased by the bottom nozzles—due to the better turbulence of the fluidized bed.

By a variation of the height and extension of the high-temperature zone, i.e. the zone of maximum temperature in the fluidized bed, due to changes in the inclination of the plasma burners 12 and the nozzles 14 and 15, the various operational conditions always can be taken into account in an optimal manner, such as, for instance, different flow speeds within the melting vessel or the respective height of the fluidized bed, which in turn depends on the particle sizes of the ores and the coke supplied.

What we claim is:

1. In a method of producing molten pig iron or steel pre-material from iron-oxide-containing raw-material particles, comprising the steps of forming a fluidized bed of carbon particles and an oxygen-containing carrier gas, top-charging said iron-oxide-containing raw-material particles into said fluidized bed, heating, reducing and smelting said iron-oxide-containing raw-material particles when passing through said fluidized bed, thereby forming a slag layer and a layer of metal melt beneath said fluidized bed, the improvement wherein plasma heating is provided for supplying additional energy to said fluidized bed, and at least one of oxygen and oxygen-containing gases is bottom-blown from beneath said layer of metal melt into said fluidized bed.

2. In a method of producing molten pig iron or steel pre-material from iron-oxide-containing raw-material particles, comprising the steps of forming a fluidized bed of carbon particles and an oxygen-containing carrier gas, top-charging said iron-oxide-containing raw-material particles into said fluidized bed, heating reducing and smelting said iron-oxide-containing raw-material particles when passing through said fluidized bed, the improvement wherein at least one of carbon carriers, oxygen and oxygen-containing gases are bottom blown into said fluidized bed from beneath a layer of metal melt formed beneath said fluidized bed, and wherein additional energy is provided to said fluidized bed by plasma heating, and wherein said fluidized bed has an upper region and a central region following thereupon, said plasma heating being effected in said upper region of said fluidized bed so as to generate and maintain there a zone of maximum temperature.

3. A method as set forth in claim 1, wherein said fluidized bed has an upper region and a central region following thereupon, and said plasma heating is effected in said upper region of said fluidized bed so as to generate and maintain there a zone of maximum temperature.

4. A method as set forth in claim 1 or 2, wherein said fluidized bed has an upper region and a central region following thereupon, and said plasma heating is effected in said central region of said fluidized bed so as to generate and maintain there a zone of maximum temperature.

5. A method as set forth in claim 1 or 2, wherein said fluidized bed has an upper region and a central region following thereupon, and said plasma heating is effected in said upper region and said central region of said fluidized bed so as to generate and maintain there a zone of maximum temperature.

6. A method as set forth in claim 1 or 2, wherein a reduction gas is generated in said fluidized bed and part of said reduction gas is used as plasma-forming gas.

7. A method as set forth in claim 1 or 2, wherein said plasma heating includes a flame region, and additional carbon carriers are introduced into said flame region.

8. A method as set forth in claim 7, wherein said additional carbon carriers are in solid form.

9. A method as set forth in claim 7, wherein said additional carbon carriers are in liquid form.

10. A method as set forth in claim 7, wherein said additional carbon carriers are in solid and liquid form.

11. A method as set forth in claim 1 or 2, wherein said iron-oxide-containing raw-material particles charged into said fluidized bed are comprised of between 50 and 70% pre-reduced iron-ore particles, said pre-reduced iron-ore particles being completely reduced in said fluidized bed.

12. A method as set forth in claim 1 or 2, which further comprises bottom-blowing carbon carriers into said fluidized bed.

13. A method as set forth in claim 12, wherein said carbon carriers are in solid form.

14. A method as set forth in claim 12, wherein said carbon carriers are in liquid form.

15. A method as set forth in claim 12, wherein said carbon carriers are in solid and liquid form.

16. A method as set forth in claim 2, further comprising bottom-blowing oxygen into said fluidized bed.

17. A method as set forth in claim 2, further comprising bottom-blowing oxygen-containing gases into said fluidized bed.

18. A method as set forth in claim 1 or 2, further comprising bottom-blowing inert gas into said fluidized bed.

19. In a plant to be used for producing molten pig iron or steel pre-material from iron-oxide-containing raw-material particles, and of the type including a melting vessel provided with a refractory lining and having a vessel wall, first openings for supplying carbon-containing and iron-oxide-containing raw-material particles, second openings for tapping slag and melt, and third openings for introducing an oxygen-containing carrier gas, and containing, in operation, a fluidized bed, the improvement wherein at least one of carbon carriers, oxygen and oxygen-containing gases are bottom-blown into said fluidized bed from beneath a layer of metal melt formed beneath said fluidized bed and wherein said fluidized bed occupies a certain space having an upper height region and a central height region, and herein plasma burners are installed in said vessel wall within at least one of said upper height region and said central height region.

20. In a plant to be used for producing molten pig iron or steel pre-material from iron-oxide-containing raw material particles, and of the type including a melting vessel provided with a refractory lining and having a vessel wall, first openings for supplying carbon-containing and iron-oxide containing raw-material particles, second openings for tapping slag and melt, and third openings for introducing an oxygen-containing carrier gas, and containing, in operation, a fluidized bed, the improvement wherein plasma burners are installed in said vessel wall within the height of said fluidized bed and wherein said vessel has a bottom which further comprises bottom nozzles comprising fourth openings for supplying at least one of a carbon carrier, oxygen, an oxygen-containing gas and an inert gas from beneath a layer of metal melt formed beneath said fluidized bed.

21. A plant as set forth in claim 20, wherein said fluidized bed contained in said melting vessel occupies a certain space having an upper height region and a central height region, said plasma burners being arranged in said upper height region.

22. A plant as set forth in claim 20, wherein said fluidized bed contained in said melting vessel occupies a certain space having an upper height region and a central height region, said plasma burners being arranged in said central height region.

23. A plant as set forth in claim 20, wherein said fluidized bed contained in said melting vessel occupies a certain space having an upper height region and a central height region, said plasma burners being arranged in said upper height region and said central height region.

24. A plant as set forth in claim 19 or 20, wherein said melting vessel has a central axis and said plasma burners are directed in the direction toward said central axis.

25. A plant as set forth in claim 19 or 20, further comprising nozzles provided in the vicinity of said plasma burners and directed into the flame region of said plasma burners for supplying carbon carriers.

26. A plant as set forth in claim 19 or 20, wherein said melting vessel has a central axis and said plasma burners are provided in an annular arrangement about said central axis.

27. A plant as set forth in claim 19 or 20, wherein said plasma burners are arranged on several levels one above the other.

28. A plant as set forth in claim 19 or 20, wherein said plasma burners are arranged to be pivotable.

29. A plant as set forth in claim 28, wherein said plasma burners are arranged to be horizontally and vertically pivotable.

30. A plant as set forth in claim 19, wherein said melting vessel has a bottom and which further comprises bottom nozzles provided in said bottom for supplying at least one of the following substances: a carbon carrier, oxygen, an oxygen-containing gas, and an inert gas.

31. A plant as set forth in claim 20, wherein said bottom nozzles supply at least one of oxygen and an oxygen-containing gas.

32. A plant as set forth in claim 20, wherein said bottom nozzles supply at least one of a carbon carrier and an inert gas.

* * * * *